US007776114B2

(12) United States Patent
Rüger et al.

(10) Patent No.: US 7,776,114 B2
(45) Date of Patent: Aug. 17, 2010

(54) PROCESS AND APPARATUS FOR THE ENDOTHERMIC GASIFICATION OF CARBON

(75) Inventors: Dietmar Rüger, Bannewitz-Goppeln (DE); Olaf Schulze, Tuttendorf (DE); Jonas Kappeller, Dresden (DE); Burkhard Möller, Kleinwaltersdorf (DE); Bodo Max Wolf, Lichtenberg (DE)

(73) Assignee: Choren Industries GmbH, Freiberg (DE)

( * ) Notice: Subject to any disclaimer, the term of this patent is extended or adjusted under 35 U.S.C. 154(b) by 1027 days.

(21) Appl. No.: 11/460,379

(22) Filed: Jul. 27, 2006

(65) Prior Publication Data

US 2007/0163176 A1 Jul. 19, 2007

(30) Foreign Application Priority Data

Jul. 28, 2005 (DE) ..... 10 2005 035 921

(51) Int. Cl.
*C10J 3/00* (2006.01)

(52) U.S. Cl. ..... 48/210; 48/197 R

(58) Field of Classification Search ..... 48/210
See application file for complete search history.

(56) References Cited

U.S. PATENT DOCUMENTS

| | | | | |
|---|---|---|---|---|
| 3,951,615 | A | | 4/1976 | Gernhardt et al. |
| 4,278,446 | A | * | 7/1981 | Von Rosenberg et al. . 48/197 R |
| 5,849,050 | A | | 12/1998 | Wolf |

FOREIGN PATENT DOCUMENTS

| | | | |
|---|---|---|---|
| CA | 2306889 | A1 | 5/1999 |
| DE | 196 18 213 | A1 | 11/1997 |
| DE | 197 47 324 | A1 | 4/1999 |
| DE | 198 07 988 | A1 | 9/1999 |
| WO | WO 95/21903 | A1 | 8/1995 |
| WO | WO 03/033624 | A1 | 4/2003 |

OTHER PUBLICATIONS

Y. G. Pan et al.., "Fluidized-bed co-gasification of residual biomass/poor coal blends for fuel gas production",Fuel, IPC Science and Technology Press, vol. 79, No. 11 (2000), pp. 1317-1326.

* cited by examiner

*Primary Examiner*—Basia Ridley
*Assistant Examiner*—Imran Akram
(74) *Attorney, Agent, or Firm*—Foley & Lardner LLP

(57) ABSTRACT

A process for the endothermic gasification of solid carbon in an entrained bed facility comprises partial oxidation of fuel(s) and endothermic gasification of solid carbon, preferably preceded by low temperature carbonization such that the carbonization gas is passed to the partial oxidation and the carbonization coke is passed to the endothermic gasification. The hot gas streaming downwardly from the combustion chamber is deflected to produce separation of the liquid slag and is then passed to the endothermic gasification that operates with a rising gas stream and with addition of solid carbon having a grain diameter of up to 20 mm. The speed of the gas at the carbon inlet is higher than, and the speed of the gas at the end of the endothermic gasification is lower than, the suspension rate of the reactive carbon particles, to produce an increase of the relative speed difference between the gas and the carbon particles. Apparatus is also disclosed for carrying out the process.

5 Claims, 1 Drawing Sheet

PROCESS AND APPARATUS FOR THE ENDOTHERMIC GASIFICATION OF CARBON

CROSS-REFERENCE TO RELATED PATENT APPLICATIONS

The right of foreign priority is claimed under 35 U.S.C. §119(a) based on Federal Republic of Germany Application No. 10 2005 035 921.3, filed Jul. 28, 2005, the entire contents of which, including the specification, drawing, claims and abstract, are incorporated herein by reference.

BACKGROUND OF THE INVENTION

The present invention relates to a process and apparatus for the gasification of solid carbon or carbonaceous material with hot gases from the partial oxidation of gaseous, liquid and solid fuels, in particular to the gasification in an entrained bed facility of coal, biomass and organic residual substances, e.g., from the recovery of waste.

The field of application of the invention is the production of fuel gas, synthesis gas and reduction gas from these fuels.

The gasification of solid carbon by means of hot gases has been known since the introduction of the processes for the production of gas by partial oxidation in fixed bed and in fluid bed reactors.

During gasification in a fixed bed reactor, the hot gas containing carbon dioxide is produced by burning solid carbon upstream in the direction of flow of the gasification medium of a so-called reduction zone. The gas carries into the reduction zone the gasification medium of carbon dioxide and the enthalpy necessary for the endothermic gasification of carbon to carbon monoxide. The partial oxidation, on the one hand, and endothermic gasification of carbon, on the other hand, thus take place in sequence, at separate locations and at different temperatures during fixed bed gasification.

The specific aspect of the gasification of fuels in the stationary or circulating fluid (fluidized) bed, on the other hand, consists of partial oxidation and endothermic gasification of solid carbon taking place practically simultaneously and at the same location, in an approximately isothermal manner.

Published patent specification WO95/21903 (corresponding to U.S. Pat. No. 5,849,050, the entire contents of which are incorporated herein by reference) discloses a method for the endothermic gasification of solid carbon with hot gas from partial oxidation in an entrained bed facility which is referred to in practice as chemical quenching. The basic principle of this process involves mixing solid carbon in the form of coal or coke from the degasification of fuels into a hot stream of gas from partial oxidation having a temperature of more than 1,200° C. and containing carbon dioxide and steam. The carbon reacts with the gas components of carbon dioxide and steam to form carbon monoxide and/or carbon monoxide and steam, by making use of the physical enthalpy of the hot gas, i.e., part of the physical high temperature enthalpy of the gas is reconverted by endothermic chemical reactions into chemical enthalpy. As a result of this measure, the calorific value of the gas increases as a result of which the degree of effectiveness of the conversion of the process is improved in comparison with those processes which merely make physical use of the physical enthalpy of the gas. During the practical application of the process disclosed in WO95/21903, it became apparent to the present inventors that the effectiveness of the endothermic gasification of solid carbon depends markedly on the method of operation of the process stages downstream and upstream, on the solid carbon charge of the hot gas and on the relative speed between gas and carbon.

In accordance with published patent specification DE 198 07 988 (corresponding to Canadian Patent No. 2,306,889, the entire contents of which are incorporated herein by reference) and similar devices, the thermal stage of processing the fuel, preferably biomass, into a tar-containing degasification gas and a tar-free coke produces a specific limited amount of coke, mainly as a result of the content of volatiles of the fuel and the heat requirement of the thermal recovery process. This coke is ground to a pulverized fuel that is suitable for pneumatic conveying, with a grain size of preferably <100 μm.

In the device according to DE 197 47 324 that is designed for implementing the process of patent specification WO95/21903, the tar-containing degasification gas is partially burned above the ash melting point with an oxygen-containing gasification medium in a combustion chamber, together with the residual coke obtained during dedusting of the gasification gas, in such a way that a hot, tar-free gasification medium containing not only CO and $H_2$ but also $CO_2$ and $H_2O$ is obtained. The fuel ash contained in the residual coke is melted during this process.

In accordance with DE 197 47 324, the hot gasification medium flows from the combustion chamber, together with the liquid slag, in the form of an immersion stream into the part of the entrained bed reactor arranged below the combustion chamber, in which reactor the endothermic reactions take place. This will be referred to as an endothermic entrained bed reactor in the following disclosure.

The finely ground coke dust is blown pneumatically via lances and nozzles into the immersion stream and, as a result of chemical quenching, leads to cooling of the gas and to an increase in the proportion of hydrogen and carbon monoxide.

At the bottom end of the endothermic entrained bed reactor, the gas is deflected and leaves the apparatus together with the unconverted part of the coke. The gas is subsequently cooled by indirect thermal dissipation and is then passed to the subsequent process stages.

To avoid coke separating off from the gas stream, the speed of the gas is preferably always greater than the rate of suspension of the coke particles, particularly at the deflection site of the gas in the reactor and in the part that may be streaming upwardly.

With this method of carrying out the process and the small grain size of the coke dust, the relative speed between the coke and gas is low, and the residence time of the coke is largely determined by the residence time of the gas, which in turn depends on the extent of the endothermic reactor.

The endothermic gasification of solid carbon with steam and carbon dioxide is a process influenced by the reaction kinetics. The rate of conversion of the solid carbon decreases with a decreasing temperature and increasing proportions of carbon monoxide and hydrogen formed. For this reason, an insufficient relative speed between the solid carbon and the gas and too short of a residence time of the carbon and the gas in the reactor is should be considered as the primary causes of the carbon conversion being too low. As a result of the small grain size and the low relative speed between the solid carbon and the gas, the residence time is not controllable in the case of executing the process according to DE 197 47 324, and it is extendable only by enlarging the reactor.

In the case of stationary fluid bed gasification, the gasification medium streams upwardly from the bottom toward the top, against the gravity. The reactor cross-section is dimensioned in such a way that the gas speed is below the rate of suspension of the fuel grains being used. As a result, an excess of fuel is always present in the reactor, in comparison with the gasification medium used and the converted fuel, guaranteeing a high conversion of the fuel.

In the case of the non-stationary fluid bed, the speed of the gas is higher than the suspension rate of the fuel grains. In this case, the required fuel conversion is achieved by recycling the non-converted part of the fuel into the reaction zone of the reactor.

In the case of the stationary and non-stationary fluid bed gasification of fuels containing proportions of volatiles, it occurs that tars and relatively large proportions of methane and other hydrocarbons are always contained in the gas, as a result of the drying, degasification and gasification processes that are taking place in parallel in the reactor. The tars need to be removed from the gas before it can be utilized for syntheses, but also in the case that the generated gas is to be utilized for energy purposes, e.g., in gas engines. This leads to high expenditure levels in gas purification and gas effluent treatment.

Other hydrocarbons, such as, e.g., methane, are not gas components that can be synthesized. They are consequently undesirable substances present in the gas and reduce the effectiveness of the synthesis.

SUMMARY OF THE INVENTION

Therefore, one object of the present invention resides in providing an improved process for the gasification of solid carbonaceous material, especially that further improves fuel utilization.

A further object of the invention is to provide an improved apparatus for carrying out gasification of solid carbonaceous material.

In accordance with one aspect of the present invention, there is provided a process for the endothermic gasification of solid carbon, comprising: conducting a partial oxidation of a fuel to produce a partial oxidation gas that contains $CO_2$ and $H_2O$ and liquid slag droplets; separating liquid slag droplets from an exit gas stream of the partial oxidation gas; and conducting an endothermic gasification by reacting the separated exit gas stream in an entrained bed with an addition of solid reactive carbon particles having a grain diameter of up to 20 mm, while creating a greater relative difference in the speed of the reactive carbon particles with respect to the speed of the gas stream at the exit end of the entrained bed than at a point at which the reactive carbon particles are added. Preferably, the entrained bed is operated under conditions of a rising gas stream, and the creation of a greater relative speed difference comprises maintaining the speed of the rising gas at an inlet point where the carbon is added higher than the suspension rate of the reactive carbon particles and maintaining the speed of the rising gas at the exit end of the entrained bed lower than the suspension rate of the reactive carbon particles.

In accordance with another aspect of the present invention, there is provided an apparatus for the endothermic gasification of solid carbon, comprising: a combustion reactor, having an inlet and an outlet, for conducting a partial oxidation of a fuel to produce a partial oxidation gas that contains $CO_2$ and $H_2O$ and liquid slag droplets; a device, positioned subsequent to the outlet of the reactor, for separating liquid slag droplets from an exit gas stream of the partial oxidation gas; an entrained bed reactor for conducting an endothermic gasification by reacting the separated exit gas stream with an addition of solid reactive carbon particles having a grain diameter of up to 20 mm; and a feeding device for adding the solid reactive carbon to the entrained bed reactor, wherein the entrained bed reactor is configured to create a greater relative difference in the speed of the reactive carbon particles with respect to the speed of the gas stream at the exit end of the entrained bed than at a point at which the reactive carbon particles are added.

Further objects, features and advantages of the present invention will become apparent from the detailed description of preferred embodiments that follows, when considered together with the accompanying figure of drawing.

DETAILED DESCRIPTION OF THE PREFERRED EMBODIMENTS

Figure 1:
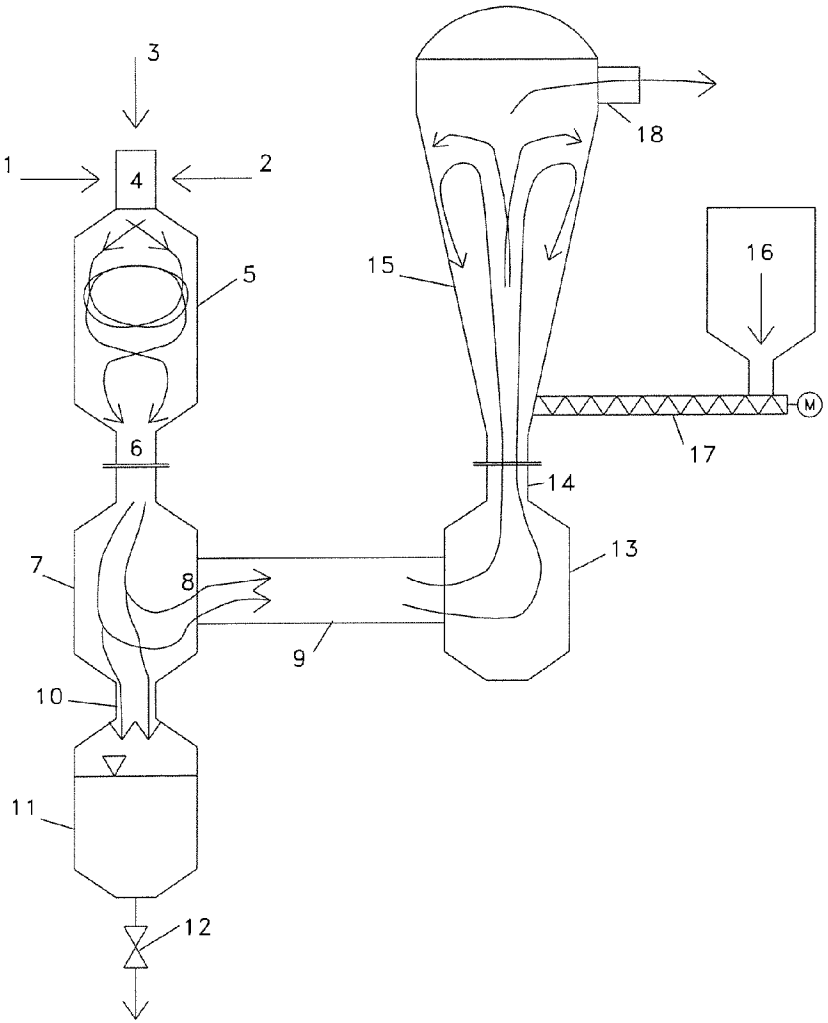
FIG. 1 is a schematic illustration of the process sequence as well as of an apparatus suitable for carrying out the process in accordance with one preferred embodiment of the invention.

It has been found advantageous to further cool the gas present after partial oxidation in the combustion chamber, by endothermic chemical reactions between the gas and solid carbon, in comparison to the prior processes. Consequently there is an increase in the removal of chemical enthalpy from the gasification process that combines the process stages of partial oxidation of the fuel with oxygen or air to hot tar-free crude gas in a combustion chamber, and the endothermic gasification of solid carbon with the hot crude gas in a subsequent process stage, in accordance with WO95/21903.

According to the invention, the hot gas streaming downwardly in the process from the combustion chamber is deflected, with separating off the liquid slag, and is passed to the process stage of endothermic gasification of solid carbon operating with a rising gas stream, while adding solid carbon, preferably coke carbon from an in-process low temperature carbonization and having a grain diameter of up to 20 mm. In this process, the gas speed at the carbon inlet is preferably maintained above, and at the end of the process stage of the endothermic gasification it is maintained below, the suspension rate of the reactive carbon particles.

EXAMPLE

The technical goal of this example is the cooling of the hot gas from the combustion chamber, which has been produced by the gasification of tar-containing pyrolysis gas and residual coke coming from the crude gas dedusting with oxygen at a temperature of approx. 1,400° C. The cooling is accomplished by chemical quenching with coke carbon that is produced from the same degasification process from which the pyrolysis gas originates. The description of the example is with reference to FIG. 1, which depicts a suitable device for carrying out the process according to this embodiment of the invention.

The tar-containing degasification gas 1, the residual coke dust 2 from crude gas dedusting and the oxygen 3 are passed to the combustion chamber 5 via separate channels of a rotary burner 4. The degasification gas and the residual coke react with the oxygen in the combustion chamber to form a gasification gas which, apart from CO and $H_2$, also contains $CO_2$ and $H_2O$ and whose temperature is above the ash melting temperature of the residual coke ash. As a result of the high temperature, the ash of the residual coke is melted and thrown by the rotation of the burner onto the combustion chamber wall, along which the liquid slag runs off from the combustion chamber 6 in the direction of the gas outlet.

Below the combustion chamber is arranged a deflection chamber 7 which is equipped laterally with a horizontal gas discharge 8 in the direction of a transfer line 9. At the bottom end of the deflection chamber 7 there is a slag run-off aperture 10 with a water-filled slag bath 11 arranged underneath.

The hot gas from the combustion chamber is deflected sharply in the deflection chamber in the direction of the transfer line 9. As a result of the centrifugal forces arising, the fine slag droplets contained in the gas stream are also separated from the gas stream and are thrown onto the wall of the deflection chamber together with the large slag particles dripping off the wall of the gas outlet 6. From there, the liquid slag runs through the aperture 10 into the slag bath 11 filled with water, where it solidifies to form solid granules which are discharged, preferably discontinuously, from the reactor via the gate valve 12.

The deflected gas flows through the transfer line 9 into a further deflection chamber 13, where the gas is deflected upwardly, preferably by 90°, and reaches the endothermic entrained bed reactor 15 via an aperture 14 arranged above the deflection chamber 13. The coke carbon 16 from the pyrolysis of the fuel with a proportion of coarse grains of up to 20 mm is transported via a screw conveyor 17 into the endothermic entrained bed reactor.

The entrained bed reactor has a cross-section that widens upwardly and is dimensioned in such a way that (1) the speed of the gas at the bottom end of the reactor is higher than the rate of suspension of the coarsest coke particles, such that no coke can fall in the direction of the deflection chamber 13, and (2) the speed of the gas at the upper end is slower than the suspension rate of the smallest reactive coke particles, such that only extremely small, fully reacted particles are able to leave the reactor together with the gas stream.

The coarsest coke particles are first carried upwardly by the gas stream until the speed of the gas decreases below the rate of suspension as a result of the widening reactor cross-section, and then they drop back until they are again transported upwardly by the gas.

As a result of the design of the reactor and the chosen grain structure of the coke, intensive mixing with large relative movements between the coke and gas take place, as well as an enrichment of coke in the reactor until a quasi-stationary state is reached, which is represented by an excess of coke with respect to the original coke-gas ratio following pyrolysis, i.e., it is possible by means of the invention to increase the ratio of solid carbon-to-gas from approximately 0.1 to more than 1.

The excess of coke and the large relative movement between the solid carbon and gas improve the kinetics of endothermic gasification of the coke carbon to CO and hydrogen, which takes place with $CO_2$ and steam from the hot gas. This leads to an increased carbon conversion and, associated therewith, to stronger cooling of the gas than in comparable processes in which solid carbon and gas have approximately the same residence time, e.g., processes according to DE 197 47 324.

The crude gas containing unreacted residual coke leaves the reactor through the gas discharge 18 and is cooled and dedusted before its subsequent utilization. The residual coke 2 separated off during dedusting passes back into the combustion chamber 5, as described above.

The foregoing description of preferred embodiments of the invention has been presented for purposes of illustration and description only. It is not intended to be exhaustive or to limit the invention to the precise form disclosed, and modifications and variations are possible and/or would be apparent in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto and that the claims encompass all embodiments of the invention, including the disclosed embodiments and their equivalents.

What is claimed is:

1. A process for the endothermic gasification of solid carbon, comprising:

conducting a partial oxidation of a fuel to produce a partial oxidation gas that contains $CO_2$ and $H_2O$ and liquid slag droplets;

guiding the liquid slag droplets and an exit gas stream of the partial oxidation gas in a downward direction and deflecting the exit gas stream, thereby separating the liquid slag droplets from the exit gas stream of the partial oxidation gas;

deflecting the exit gas stream separated from liquid slag droplets to obtain a rising gas stream; and conducting an endothermic gasification by reacting the rising gas stream in an entrained bed with an addition of solid reactive carbon particles having a grain diameter of up to 20 mm, while creating a greater relative difference in the speed of the reactive carbon particles with respect to the speed of the gas stream at the exit end of the entrained bed than at a point at which the reactive carbon particles are added, the creating a greater relative difference in the speed comprising:

maintaining the speed of the rising gas stream at an inlet point where the carbon is added higher than the suspension rate of the reactive carbon particles; and maintaining the speed of the rising gas stream at the exit end of the entrained bed lower than the suspension rate of the reactive carbon particles.

2. A process as defined in claim 1, wherein the solid reactive carbon comprises coke carbon.

3. A process as defined in claim 1, the fuel of the partial oxidation step comprises a carbonization gas from a low temperature carbonization of a carbon source selected from the group consisting of a renewable or fossil fuel, a biomass, refuse, sludge and a mixture thereof.

4. A process as defined in claim 3, wherein the reactive carbon added during the endothermic gasification step comprises carbonization coke from said low temperature carbonization.

5. A process as defined in claim 1, wherein the speed of the rising gas is maintained by using an entrained bed having a smaller flow cross-section at a lower portion than at its exit end.

* * * * *